United States Patent [19]

Luch

[11] 4,195,117

[45] Mar. 25, 1980

[54] PROCESS FOR ELECTROPLATING DIRECTLY PLATEABLE PLASTIC WITH NICKEL-IRON ALLOY STRIKE AND ARTICLE THEREOF

[75] Inventor: Daniel Luch, Warwick, N.Y.

[73] Assignee: The International Nickel Company, Inc., Suffern, N.Y.

[21] Appl. No.: 19,074

[22] Filed: Mar. 9, 1979

[51] Int. Cl.[2] ..... B23P 3/20; C25D 5/10; C25D 5/12; C25D 5/14

[52] U.S. Cl. ..... 428/626; 204/23; 204/41; 204/43 T; 428/667; 428/678; 428/679; 428/680

[58] Field of Search ..... 428/626, 667, 678; 204/43 T, 23, 41, 20, 30, 40

[56] References Cited

U.S. PATENT DOCUMENTS 3,865,699 2/1975 Luch ..... 204/20

FOREIGN PATENT DOCUMENTS 997898 7/1965 United Kingdom ..... 204/43 T

*Primary Examiner*—G. L. Kaplan

*Attorney, Agent, or Firm*—Francis J. Mulligan, Jr.; E. C. MacQueen

[57] ABSTRACT

Discloses the use of nickel-iron alloy strike deposits on directly plateable plastics whereby difficulties encountered in plating directly plateable plastics are obviated and plated objects suitable for service conditions 3 and 4 or equivalent service conditions are provided.

5 Claims, No Drawings

PROCESS FOR ELECTROPLATING DIRECTLY PLATEABLE PLASTIC WITH NICKEL-IRON ALLOY STRIKE AND ARTICLE THEREOF

BACKGROUND OF THE INVENTION AND PROBLEM

The present invention is concerned with electroplated directly plateable plastics for conditions equivalent to and more severe than Service Conditions SC 3 and SC 4 and more particularly with electroplated directly plateable plastics for such service conditions which have nickel-iron alloy strike deposits directly and immediately deposited on the directly plateable plastics.

As of now, there have been a number of disclosures with respect to plastic compositions which can be electroplated without the need for the use of complex preplating systems which are necessary with electroplating conventional plastics such as ABS. These disclosures include the Luch U.S. Pat. No. 3,865,699, the Hurley et al. U.S. application Ser. No. 827,986 and PRODUCTS FINISHING, January, 1978, pages 78 to 80. Up to now, the use of such "directly plateable plastics" (DPP) has been hindered by the fact that "precautions" as disclosed in Luch U.S. application Ser. No. 735,312 should be taken in order to insure the stability of the strong initial bond which forms between electrodeposited group VIII metal and the plastic substrate when the plated plastic object is subjected to corrosion and thermal cycling tests appropriate to Service Conditions SC 3 and SC 4.

The terms "Service Conditions SC 3 and SC 4" are taken from ANSI/ASTM specification B604-75 section 6.3 Service Condition Number which reads as follows:

6.3 Service Condition Number:

6.31 The service condition number indicates the severity of the service conditions in accordance with the following scales:

SC 4—very severe service
SC 3—severe service
SC 2—moderate service
SC 1—mild service 6.32 Typical service conditions for which the various service condition numbers are appropriate are given in Annex Al.

6.4 Coatings Appropriate to Each Service Condition Number—Table I shows the coating classification numbers appropriate for each service condition number.

Al. DEFINITIONS AND EXAMPLES OF SERVICE CONDITIONS FOR WHICH THE VARIOUS SERVICE CONDITION NUMBERS ARE APPROPRIATE

Al.1 Service Condition No. SC 4 (Very severe)—Service conditions that include likely damage from denting, scratching, and abrasive wear in addition to exposure to corrosive environments and temperature extremes; for example, conditions encountered by exterior components of automobiles and by boat fittings in salt water service.

Al.2 Service Condition No. SC 3 (Severe)—Exposure that is likely to include occasional or frequent wetting by rain or dew or strong cleaners and saline solutions and temperature extremes; for example, conditions encountered by porch and lawn furniture, bicycle and perambulator parts, and hospital furniture and fixtures.

Al.3 Service Condition No. SC 2 (Moderate)—Indoor exposure in places where condensation of moisture and temperature extremes may occur; for example, in kitchens and bathrooms.

Al.4 Service Condition No. SC 1 (Mild)—Indoor exposure in normally warm, dry atmospheres with coating subject to minimum wear or abrasion.

Table II of Specification No. B604 specifies Corrosion tests appropriate for each Service Condition number as follows:

| Service Condition Number | Duration of Corrosion (CASS) Test(a) |
|---|---|
| SC 4 | three 16-h cycles(b) |
| SC 3 | two 16-h cycles(b) |
| SC 2 | 8 h |
| SC 1 | — |

Also pertinent is paragraph 5.4 of Standard Recommended practice for Thermal Cycling Test for Evaluation of Electroplated Plastics ASTM B553-71 which reads as follows:

5.4 Subject the sample to a thermal cycle procedure as follows:

| Service Condition | High Limit | Low Limit |
|---|---|---|
| 1 (mild) | 60 C | −30 C |
| 2 (moderate) | 75 C | −30 C |
| 3 (severe) | 85 C | −30 C |
| 4 (very severe) | 85 C | −40 C |

Each thermal cycle begins with either placing the samples in a room-temperature chamber and heating the chamber up to the high limit or placing the samples directly into a chamber at the high limit.

NOTE: Suggested definitions of service conditions appear in the Appendix. Alternatively, the definition may be one agreed upon between the purchaser and seller.

5.41 Expose the parts for 1 h at the high limit.

5.42 Allow the parts to return to 22±3 C, as quickly as possible and maintain at this temperature for a total cooling period of 1 h. This is frequently accomplished by removing the parts from the chamber, however, some types of apparatus are so constructed that the parts need not be removed during this step.

5.43 Expose the part for 1 h at the lower limit.

5.44 Repeat 5.42. This constitutes one full thermal cycle.

From the foregoing, it is clear that plated plastic articles for Service Conditions SC 3 and SC 4 must withstand thermal cycling tests having a high limit of 85° C. and a plurality of 16 hour CASS Corrosion Test cycles. These tests are generally considered to be minimum. Automotive manufacturers have generally stiffened the tests by requiring combined thermal cycle-CASS Corrosion Testing for plated plastic objects designed for exterior automotive use and lengthened thermal cycle test periods for plated plastic objects designed for interior automotive use. Although items employed interior automotive use are not ordinarily subjected to significant, corrosive media, such use is equivalent to SC 3 and SC 4 because of the abnormally high interior temperatures encountered in a locked-up car exposed to summer sum. Plated plastic objects must also have long term bond stability regardless of the thermal or corrosive conditions encountered. The present invention tends to assure such long term bond stability as well as resistance to the effects of exposure to severe conditions.

The reasons why the "precautions" disclosed in U.S. application Ser. No. 735,312 were deemed necessary when providing plated objects made of directly plateable plastic for exterior automotive use are set forth in the record in that application. In order that the art may be fully aware of the problems encountered in the plating of directly plateable plastics, this background, heretofore believed to be solely within the knowledge of applicants, their assignee, their co-workers, and the Patent Office, is paraphrased as follows:

'In U.S. Pat. No. 3,865,699 Luch disclosed that a polymer composition containing carbon black and sulfur reacted with group VIII metal electrodeposited on the polymer surface so as to enhance the rate of coverage of the polymer surface and to provide a strong metal-polymer bond. During the development work carried out in order to translate the patentable discovery of U.S. Pat. No. 3,865,699 into a commercial reality, it was found that the strong bond initially obtained between the polymer composition and the metal, specifically nickel, could be degraded by means, which for many months, remained obscure.'

'After considerable development effort, Luch discovered that the bond between plastic composition and the electroplated metal was destroyed or minimized by certain active chemical species exemplified by active or nascent hydrogen and free radicals. Nickel plating is rarely seen by the public. Nevertheless, it is an indispensible underlayer for the bright chromium plating that is ubiquitous on the modern American automobile. During the development work, Luch had been refining the techniques for plating nickel on various plastic objects with excellent success without taking the final step of plating a few microinches of chromium on the surface. He reasoned that if the underlayment was firmly bonded to the plastic, the outer layer of chromium would make no appreciable difference. When he finally plated chromium on the nickel-plated plastic surface and subjected the plated object to mild heat, he found to his chagrin that plating the final, thin outer layer or chromium caused the inner metal-plastic bond to drastically weaken.'

'One cause of the problem was isolated by an experiment involving a nickel plated plastic containing carbon black and sulfur as a cathode in an aqueous acidic solution thereby generating hydrogen on the cathode surface. When the plastic was employed as a cathode for the production of hydrogen, bond strength, after heating, was destroyed. It was thus proven that the formation of hydrogen incidental to the electrodeposition of chromium was a cause of failure of the plated plastic. In a similar manner, active chemical species, perhaps free radicals or nascent hydrogen, remaining in the polymer-carbon-black-sulfur plastic mass as a result of compounding or molding also act in some manner to destroy or minimize the bond between the electroplated metal and the plastic substrate.'

'Once the causes of the problem were uncovered, a solution thereto was relatively simple. First, after molding an object to be plated, the molded object should be "aged" to allow free radicals or their equivalents to dissipate. Secondly, once an initial layer of group VIII metal is plated on the carbon-black-sulfur-polymer substrate, that layer must be isolated from contact with nascent hydrogen.'

The two numbered statements in the preceding paragraph embody the principal features of the precautions which, heretofore, have been necessary in order to successfully electroplate, for use in severe corrosion environments, directly plateable plastic objects made of a composition containing polymer, carbon black and sulfur.

DISCOVERY AND OBJECTS

It has now been discovered that the circumstances described in the foregoing paraphrase which have heretofore hindered the use of directly plateable plastics can be overcome by a simple expedient as disclosed herein and defined by the claims.

It is an object of the present invention to provide novel electroplated plastic structures for use under service condition SC 3 and more severe service conditions and a process for making such structures.

Other objects and advantages will become apparent from the following description.

GENERAL DESCRIPTION

Generally speaking the present invention contemplates a plated plastic object suitable for Service Conditions 3 and more severe service conditions characterized by ability to pass a combined thermal cycle—CASS test or lengthened thermal exposure or cycle tests comprising (a) a abase of directly plateable plastic (as hereinafter defined) (b) an electrodeposit of nickel-iron alloy (as hereinafter defined) directly adhered to said directly plateable plastic base (c) a layer of corrosion-resistant electrodeposited nickel (as hereinafter defined) at least initially containing hydrogen atop said electrodeposit of alloy and (d) a decorative electrodeposit of chromium on the surface of said plated plastic object.

For purposes of this specification and claims, a directly plateable plastic (DPP) is a composition containing a polymer, carbon black and sulfur as disclosed in U.S. Pat. No. 3,865,699. A particularly advantageous DPP is disclosed in U.S. application Ser. No. 827,986 filed in the name of Hurley et al. on Aug. 26, 1977, and incorporated herein by reference. This application discloses and claims DPP's having compositions within the following ranges:

| INGREDIENT | % BY WEIGHT |
|---|---|
| Carbon black | 25–41 |
| Elemental sulfur | 0.15–1.5 |
| MBT or MBTS | 0.2–1.5 |
| ZnO | 0–0–7 |
| Polymer* | Balance essentially |
| S/MBT or MBTS | 0.5–6.0 |

*The polymer is from the group of ethylene-propylene copolymers, propylene and ethylene homopolymer, and propylene and ethylene homopolymers or copolymers in admixture with a saturated rubber flexiblizer said admixture having a weight ratio of rubber to homopolymer or copolymer of up to 1.

Compositions of matter within the foregoing ranges in the melt-blended and cooled condition generally have electrical resistivities below about 200 ohm-centimeters.

For purposes of this specification and claims, nickel-iron alloys contain, in percent by weight, at least about 50% nickel and at least about 5% iron, i.e., about 5% to 50% iron, 0 to about 20% cobalt.

For purposes of the present specification and claims, the term "corrosion resistant electrodeposited nickel" means any nickel electrodeposit consisting essentially of pure nickel or nickel plus cobalt and specifically includes electrodeposited nickel containing small amounts of sulfur and/or other residuums from brightening and/or stress relieving agents in plating baths.

The plated plastic product of the present invention is made by molding a DPP into any desireable shape and, after at most a minimal aging, inserting the molded object as a cathode into a plating bath capable of codepositing nickel and a minimum amount of iron with or without cobalt onto the cathode. As previously disclosed with respect to nickel, the potential is initially maintained at a low level and gradually increased in order to allow the plastic object to be completely covered with metal without burning. Full voltage can ordinarily be applied after a few minutes and thereafter plating can proceed normally to deposit a strike layer of nickel alloy, a superimposed layer or layers of corrosion resistant nickel and, usually, a top layer of chromium.

As stated hereinbefore, the principal problems which have occurred in plating DPP heretofore are disclosed in the Luch U.S. application Ser. No. 735,312 and these disclosures are incorporated herein by reference. Among these problems, the most serious is that caused by the release of hydrogen during the electrodeposition of bright nickel and chromium. Nascent hydrogen released during bright nickel and chromium plating at least initially permeates the electroplated metal, and up to now, unless a hydrogen barrier such as a copper layer is in the plate, a nickel-plastic bond will fail when the plated object is subjected to thermal cycling. When, in accordance with the present invention, a nickel alloy is directly adhered to the plastic, the plastic object can be top-plated with chromium in the absence of a hydrogen barrier and the plastic metal bond will not fail during subsequent thermal cycling. Applicants have no explanation for this phenomenon. That the nickel alloy might be acting as a self hydrogen barrier, is disproven by the fact that the nickel alloy is ineffective as a means of retaining bond strength unless it is directly adhered to the DPP. While the examples in the present specification show that a hydrogen barrier is not necessary in the electrodeposit of the invention, it has been found advantageous in some instances to include in the plating operation a step of providing a flash layer of Watts (or other pure) nickel over the nickel-iron alloy flash and a subsequent step of providing a copper layer under the decorative nickel and chromium toppings. The purpose of this copper layer is not as a hydrogen barrier, since, such a layer is not necessary as shown by the examples in the present application, but rather this copper layer serves the same purposes that it does in conventional deposits on conventional plastics.

The present invention is concerned with electroplated plastic objects suitable for service conditions at least as severe as service condition SC3, for example, exterior automotive usage where the plated object is subjected in use to corrosion and a wide range of service temperatures, i.e., from frigid arctic to tropical, with improving long term bond stability in whatever service conditions are encountered and in permitting a greater flexibility in manufacturing conditions outside the immediate plating process.

PARTICULAR DESCRIPTION

Table I identifies a number of patents which disclose baths from which and methods by which satisfactory nickel alloy electrodeposits can be made.

TABLE I

| U.S. PAT. NO. | INVENTOR | DATE |
|---|---|---|
| 3,878,067 | Tremmel | 4/15/75 |
| 3,922,209 | Passal | 11/25/75 |
| 3,969,198 | Law et al. | 7/13/76 |
| 3,974,044 | Tremmel | 8/10/76 |
| 4,002,543 | Clauss et al. | 1/11/77 |
| 4,010,084 | Brugger et al. | 3/01/77 |
| 4,014,759 | McMullen et al. | 3/29/77 |
| 4,036,709 | Harbulak | 7/19/77 |
| 4,053,373 | McMullen et al. | 10/11/77 |

In carrying the invention into practice, nickel-iron plating baths used in the Udylite NIRON* bright ferronickel plating process have been employed to produce nickel-iron alloys. It is believed that such baths are disclosed in any one or more of the aforelisted Tremmel and Clauss et al patents. As disclosed in technical literature distributed by Udylite Division of OXY METAL INDUSTRIES CORPORATION, air-agitated baths for use in the NIRON process contain the ingredients as set forth in Table II.

TABLE II

| | Optimum | Range |
|---|---|---|
| Total Nickel Content | 39 g/l | 30-60 g/l |
| Total Chloride Content | 18 g/l | 11-30 g/l |
| Nickel Sulfate ($NiSO_4 . 6H_2O$) | 105 g/l | 49-150 g/l |
| Udychlor 67 ($NiCl_2 . 3\frac{1}{2} H_2O$) | 48 g/l | 30-90 g/l |
| Boric Acid ($H_3BO_3$) | 45 g/l | 40-56 g/l |
| Total Iron (Fe) | 2 g/l | 1-4 g/l |
| % Ferric Iron ($Fe^{+3}$) | Less than 40% of total iron up to a maximum of 1 g/l (0.13) oz/gal | |
| NIRON* STABILIZER NF | 20 g/l | 15-49 g/l |
| NIRON* BRIGHTENER FN-1 | 2.5% | 2-3% |
| NIRON* FN-2 INDEX** | 1.6 | 1.2-2.5 |

*Tradenmark
**An arbitrary index not equivalent to concentration providing a relative guide to brightening effect of Udylite FN-2s brightener.

The optimum bath composition set forth in Table II gives electrodeposits of alloy containing about 20% iron balance essentially nickel. The ratio of iron to nickel was varied from the optimum in a number of instances as discussed hereinafter.

Strike plating of directly plateable plastic in any of the baths disclosed in the aforelisted patents in Table I, or the baths of Table II should be done in accordance with normal practice as taught in the art except that voltage ramping is normally used in order to achieve complete coverage of the plastic object. Ramping can be conveniently done by applying a voltage of one volt for 1 minute, 2 volts for a second minute and 3 volts for a third minute. Other ramping sequences can also be used. Full amperage is thereafter applied for such time as is necessary to complete a strike deposit about 10 to about 50 μm thick. Thereafter plating can be carried out in any fashion desired with no necessity for any hydrogen barrier layer to be present in the total plate.

EXAMPLES

A series of tests were conducted for the purpose of determining minimum amounts of iron would be effective to prevent destruction of a metal-polymer bond when a fully plated nickel-chromium test plaque is subjected to 85° C. for 16 hours. For the purposes of these tests, the following materials and procedures were used:

Directly Plateable Plastic comprising in percent by weight about 30.5% carbon black, about 0.6% each of elemental sulfur and mercaptobenzothiazole, about 2.86% zinc oxide, about 4.76% mineral oil with the balance being essentially ethylene-propylene copolymer was used. This composition was molded into 7.62×10.16 cm test plaques which were aged either 4 days or 6 days prior to plating.

The test plaques were initially strike plated with a number of different baths and then uniformly were plated with about 20 μm of semi-bright nickel from a PERFLOW bath, about 7.6 μm bright nickel from a UDYLITE 66 bath and about 0.38 μm regular chromium from a non-proprietary bath containing 250 g/liter $CrO_3$ and 2.5 g/liter of sulfate ion. Strike platings were as follows:

A: 100% Ni Watts bath

B: 100% Ni NIRON bath containing all addition agents of the NIRON baths as disclosed hereinbefore but free from iron C: 65% Ni-35% Fe NIRON* electrodeposit from bath containing 6.0 g/liter of Fe D: 94% Ni-6% Fe NIRON* electrodeposit from bath containing 0.6 g/l of Fe made by mixing 9 parts of B with 1 part of C E: 87% Ni-13% Fe NIRON* electrodeposit from bath containing 1.6 g/l of Fe made by mixing about 27 parts of C with 73 parts of B F: 80% Ni-20% Fe NIRON* electrodeposit from 3.1 g/l of Fe made by mixing about 52 parts of C with 48 parts of B G: 75% Ni-25% Fe electrodeposit from bath (without brighteners) prepared by adding ferrous sulfate (5 g/liter of iron) an iron stabilizer (20 g/liter NIRON* Stabilizer NF) and a stress reducer (2 vol % NIRON* Additive FN-1) to a Watts bath.

H: 100% iron-made up by dissolving 238 grams of ferrous sulfate heptahydrate in water to provide a liter of solution adjusting the pH to about 2.8 to 3.5 and the surface tension to 40 dynes/cm.

*Trademark

Approximately the same procedure was used for depositing the Ni and Ni-Fe strike coatings. This involved voltage "ramps" of 1 V for 30 sec., 2 V for 30 sec., 3 V for 30 sec., and 50 A/ft$^2$ for 4 minutes. Generally, additional time at 3 V was required for complete metal coverage prior to the 4 minutes final strike coating.

The 100% Fe deposit required a voltage "ramp" of 1 V for 30 sec., 2 V for 2 min., and 25 A/ft$^2$ for 5 min.

Following completion of plating with nickel and chromium, plaques were exposed at 85° C. for 16 hours and then tested for coating adhesion in a qualitative peel test. Plate adhesion was rated on a scale of 0-5 (5=best) as follows:

0—Coating separated from plastic on cooling.

1—Slight flexing of panel resulted in coating separation.

2 through 4—Increasing difficulty to peel coating from plastic.

5—Could not peel coating from plastic.

It would appear that peel ratings greater than 3 are needed for a practical strike coating.

Results of the tests are set forth in Table III.

TABLE III

| Test No | Plaque Age (Days) | Strike Bath | Highest Peel Rating |
|---|---|---|---|
| 1 | 4 | A | 0 |
| 2 | 4 | B | 1 |
| 3 | 4 | C | 5 |
| 4 | 4 | F | 5 |
| 5 | 4 | E | 5 |
| 6 | 4 | D | 3 |
| 7 | 6 | A | 1 |
| 8 | 6 | B | 1 |
| 9 | 6 | C | 5 |
| 10 | 6 | F | 3 |
| 11 | 6 | E | 4 |
| 12 | 6 | D | 4 |
| 13 | 6 | G | 4 |
| 14 | 6 | H | 1 |

Table III shows that Strike Baths A (100% nickel Watts bath), B (100% nickel with NIRON* additives, and H (100% iron) are unsuited as a basis for an all-nickel (topped with chromium) plate on directly plateable plastic when service conditions require resistance to damage caused by heating to 85° C. (Service Conditions 3 and 4). While these particular tests did not include subjecting specimens to thermal cycles, they did involve exposure of the specimens to 85° C. for longer than normally tested and showed by test No. 6 wherein a strike layer containing 6% iron was used that minimum amounts of iron are required in strike alloys to give thermal stability to the strike alloy-plastic bond when the strike alloy is adjacent metal containing hydrogen produced during chromium deposition.

All-nickel/chromium plated directly plateable plastic objects having a strike of nickel-iron alloy plated from a NIRON* plating bath as set forth in Table II were subjected to combined thermal cycle—CASS tests as specified by two major automotive manufacturers. Table IV sets forth results from ten specimens subjected to three test cycles, each cycle consisting of 2 hours at 85° C., 2 hours at room temperature, 2 hours at −30° C., 2 hours room temperature and 16 hours of CASS testing.

TABLE IV

| ASTM RATINGS AND DEFECTS* AFTER | | |
|---|---|---|
| 1st cycle | 2nd cycle | 3rd cycle |
| 9/9 sB, sRs | 9/8 sB, sRs, sS | 9/8 sB, sRs |
| 9/9 sB, sRs | 9/8 sB, sRs, sS | 8/7 sB, sRs, sS, sSp |
| 9/9 spR | 9/8 sB, sRs, sS | 8/8 sB, sRs, sSp |
| 9/9 spR | 9/9 sB, sRs, sS | 9/8 sB, sRs, sSp |
| 9/9 sB, sRs | 8/7 isB, sRs, sS | 7/6 isB, 1B, sRs, sSp |
| 9/9 sB, sRs | 7/6 isB, isRs, sS | 6/6 isB, 1B, iRs, sSp |
| 10/10 | 10/10 | 10/9 sS |
| 9/9 sB, sRs | 9/9 sB, sRs, sS | 8/7 sB, sRs, sSp |
| 9/9 sB, sRs | 8/8 sB, sRs | 8/7 sB, sRs, sSp |
| 10/10 | 10/10 | 10/9 vsB, sS |

TABLE V sets forth the results of testing ten specimens in the following manner; 22 hours of CASS testing followed by four thermal cycles each cycle consisting of 2 hours at 85° C., 2 hours at room temperature, 2 hours at −30° C. and 2 hours at room temperature, and after completion of four such cycles a second 22 hour CASS test.

TABLE V

| ASTM RATINGS AND DEFECTS* AFTER | | |
|---|---|---|
| 1st 22 hr. CASS | 4th Thermal cycle | 2nd 22 hr. CASS |
| 9/8 sB, sRs | 9/8 sB, sRs | 8/8 sB, sRs |
| 8/8 sB, sRs | 8/8 sB, sRs | 8/8 sB, sRs |

TABLE V-continued

| ASTM RATINGS AND DEFECTS* AFTER | | |
|---|---|---|
| 1st 22 hr. CASS | 4th Thermal cycle | 2nd 22 hr. CASS |
| 9/9 sB | 9/9 sB, sRs | 8/8 sB, sRs |
| 9/9 sRs | 9/9 sB, sRs | 9/9 sB, sRs |
| 9/9 sB, sRs | 8/7 sB, sRs | 7/7 sB, sRs |
| 8/8 sB, sRs | 7/6 sB, 1B, sRs | 6/6 isB, iRs, 1B |
| 10/10 | 10/9 vsB | 10/9 vsB |
| 8/8 sB, sRs, spR | 7/7 sB, sRs | 7/7 sB, sRs |
| 9/9 sSp, sRs | 9/9 sB, sRs | 8/7 sB, iRs, sSp |
| 10/10 | 10/10 | 10/9 vsB |

*ABBREVIATIONS DESCRIBING DEFECTS

A1.1 Types of Failure

R = corrosion (rusting) of the basis metal. (Permanent or massive type of basis metal corrosion such as that in pinholes, bare, or flaked areas, or in craters of broken blisters.)

Rs = stain due to basis metal corrosion products, such as rust stain, which can be removed readily with a damp cloth or chamois and mild abrasive revealing a sound bright surface.

S = stains or spots other than that of obvious basis metal corrosion products.

Sp = surface pits. Corrosion pits probably not extending through to the basis metal-that is, absence of obvious basis metal corrosion products bleeding therefrom.

F = flaking or peeling of deposit

B = blistering

C = cracking

Z = crazing

W = crow's feet

A1.2 Degree or Extent of Pinhole Rusting, Staining, Surface Pitting, Flaking, etc.

vs = very slight amount s = slight amount i = intermediate or moderate amount x = excessive amount A1.3 Description of Blisters s = less than about 0.5 mm in diameter i = about 0.54 to 2.5 mm in diameter x = greater than about 2.0 mm in diameter vf = 5 or fewer f = 5+ to 25 i = 10+ to 25 m = 25+ to 50 vm = over 50

A1.4 Description of Location of Defects e = edge g = general

Additional tests for thermal stability of directly plateable plastic objects having nickel-iron alloy strike deposits indicate that the bond between the directly plateable plastic and the alloy strike is exceptionally stable to thermal degradation. Contrarywise, when the alloy deposit is separated from the directly plateable plastic by a layer of nickel, the total deposit is topped with chromium and no copper or other hydrogen barrier layer is present, the plated deposit completely exfoliates after exposure to 85° C. for 16 hours in the same manner as does a nickel strike, all-nickel chromium plate.

It is a particular advantage of the use of an alloy strike deposit on directly plateable plastic that the plastic need not be aged prior to plating. Although the examples set forth herein specify aging of the plastic for some days, this was done merely to control experimental variables. Subsequent experience has shown that aging is not necessary. This provides for greater flexibility in manufacturing than previously obtainable and gives a wider window of compounding and molding variables for satisfactory product performance.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. In an electroplated chromium-topped, directly plateable plastic object, suitable for a service condition at least as severe as service condition 3 or for a service condition requiring long term heat resistance, having a corrosion-resistant electrodeposited nickel layer underlying said chromium, the improvement comprising providing a nickel-iron alloy containing about 5% to about 50% iron, up to 20% cobalt balance essentially nickel, as a strike electrodeposited layer immediately adherent to said directly plateable plastic.

2. A plastic object as in claim 1, wherein the strike layer is a nickel-iron alloy containing about 6% to 25% iron balance nickel.

3. A plastic object as in claim 1, wherein the strike layer is an alloy containing about 20% iron, balance nickel.

4. In the process of electroplating directly plateable plastic to provide a plated object suitable for service conditions at least as severe as service condition SC3 or for a service condition requiring long term heat resistance, the improvement comprising employing as a strike deposit a nickel-iron alloy containing about 5% to about 50% iron, up to 20% cobalt, balance essentially nickel.

5. A process as in claim 4, wherein a molded directly plateable plastic object is electroplated without aging after molding.

* * * * *